US006792996B1

(12) United States Patent
Yu et al.

(10) Patent No.: US 6,792,996 B1
(45) Date of Patent: Sep. 21, 2004

(54) VENETIAN BLIND

(75) Inventors: Fu-Lai Yu, Taipei Hsieh (TW); Chin-Tien Huang, Taipei Hsieh (TW); Shun-Chi Yu, Taipei Hsieh (TW)

(73) Assignee: Teh Yor Industrial Co., Ltd., Taipei (TW)

( * ) Notice: Subject to any disclaimer, the term of this patent is extended or adjusted under 35 U.S.C. 154(b) by 0 days.

(21) Appl. No.: 10/413,200

(22) Filed: Apr. 14, 2003

(51) Int. Cl.[7] ..... E06B 9/30
(52) U.S. Cl. ..... 160/176.1 R; 160/178.3
(58) Field of Search ..... 160/168.1 R, 176.1 R, 160/178.3 R, 173 R, 84.04, 84.05, 89

(56) References Cited

U.S. PATENT DOCUMENTS 2,267,869 A * 12/1941 Loehr ..... 160/89
4,951,729 A * 8/1990 Chi Yu ..... 160/178.3
5,165,459 A * 11/1992 Gaber et al. ..... 160/168.1 R
5,375,642 A * 12/1994 Gaber et al. ..... 160/168.1 R
5,409,050 A * 4/1995 Hong ..... 160/168.1 R
5,582,226 A * 12/1996 Voss et al. ..... 160/168.1 R
5,845,690 A * 12/1998 Colson et al. ..... 160/84.01
6,029,734 A 2/2000 Wang et al. ..... 160/170
6,354,353 B1 * 3/2002 Green et al. ..... 160/84.04

FOREIGN PATENT DOCUMENTS

DE 28 44 891 A1 4/1980

* cited by examiner

*Primary Examiner*—David Purol
(74) *Attorney, Agent, or Firm*—Olson & Hierl, Ltd.

(57) ABSTRACT

An improved Venetian blind type window covering having an open position and a closed position is provided. When in a closed position, the window covering presents a face that conceals a securement member and an adjustment member. The window covering also includes a bottom rail, and a plurality of slats between the head rail and the bottom rail. The securement member and the adjustment member, in cooperation, are suitable for adjustably moving or tilting the plurality of blind slats to open and close the window covering. A blind slat tilting mechanism causes positional adjustment of the plurality of blind slats by raising and lowering at least the adjusting member.

78 Claims, 6 Drawing Sheets

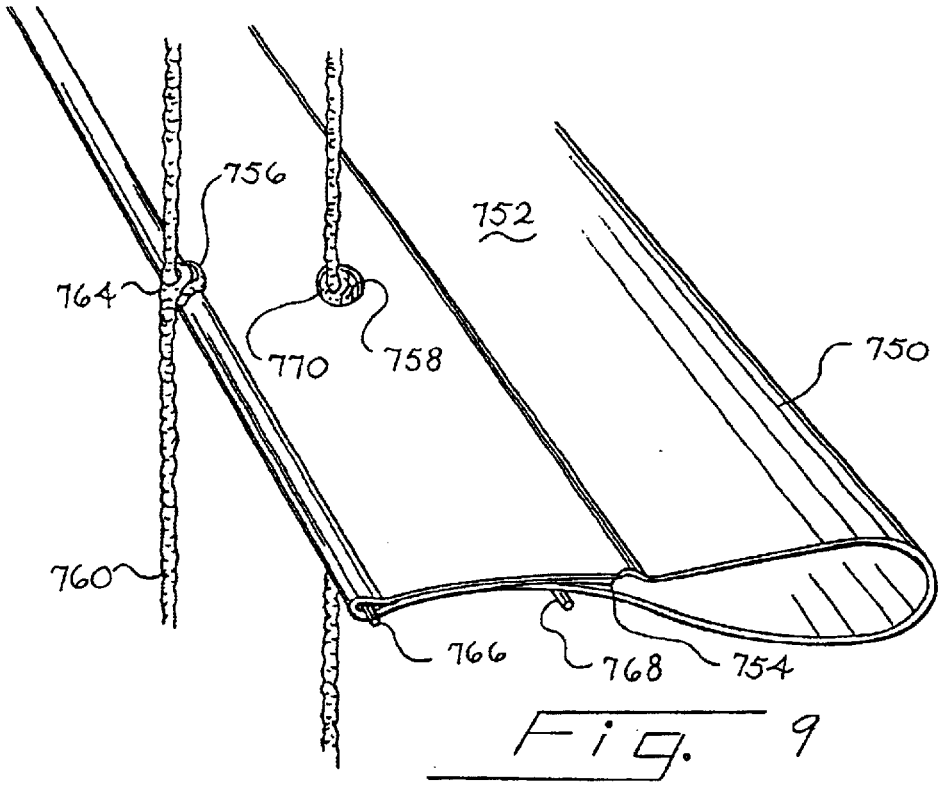
Fig. 9
Fig. 10
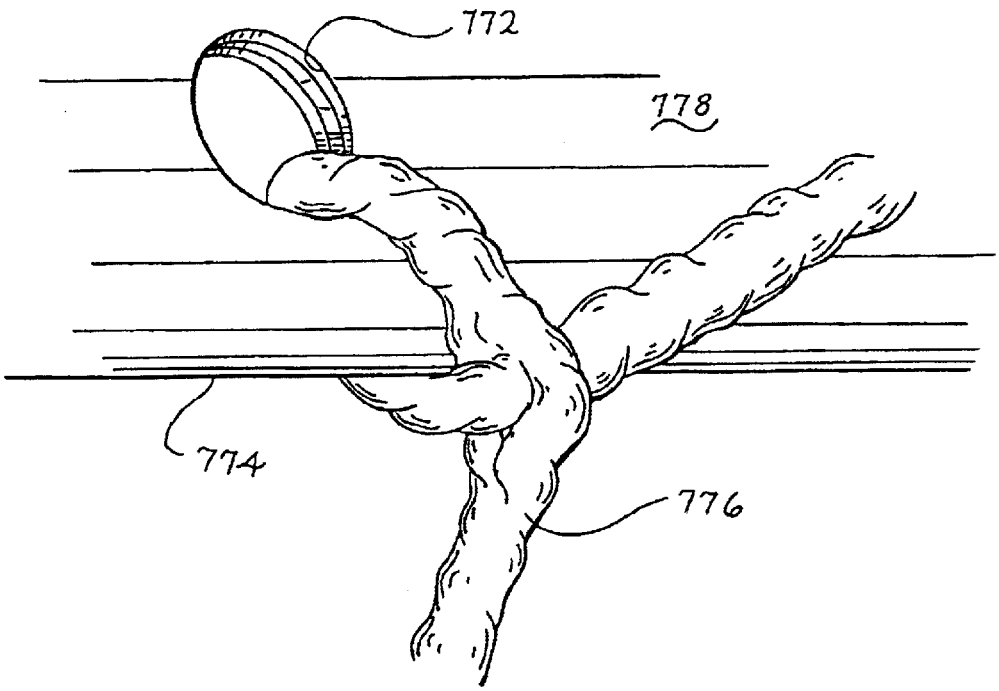

VENETIAN BLIND

TECHNICAL FIELD OF THE INVENTION

This invention relates to an improved window covering. More particularly, this invention relates to an improved window covering of the Venetian blind type comprising a plurality of blind slats, wherein one side of the shade is typically arranged to face the interior of a room.

BACKGROUND OF THE INVENTION

A Venetian blind is widely welcomed as a window covering because it provides the functions of blocking sun rays, adjusting indoor brightness, decorating rooms, providing privacy, etc. A conventional Venetian blind typically includes a head rail, a bottom rail, a plurality of slats, a raising mechanism including multiple raising cords, and a tilting or adjustment mechanism including multiple ladder strings. The lifting member typically comprises cords that are laterally symmetrically provided on the blind to balance the bottom rail and the slats for them to be lowered or lifted synchronously. By pulling the raising cords, the bottom rail and the slats are lifted or lowered relative to the head rail as desired.

The slats can be tilted upward or downward through operation of the tilting mechanism which adjusts the ladder strings. In this regard, each ladder generally includes a front and rear, and vertically-extending members or strings connected to each other by a plurality of vertically-spaced cross-rungs. Supported on each cross-rung, between the vertically-extending members of its ladder, is one length-wise side of a slat. The head rail generally includes this tilting or adjusting mechanism for moving the ladders, so that the vertically-extending members of each ladder move in opposite vertical directions relative to one another, to pivot each slat about its length-wise axis. By tilting the above-mentioned slats to a different angle of inclination, the amount and direction of light projected into a room through the Venetian blind can be controlled and adjusted.

Venetian blinds, however, have the aesthetic drawback that the ladder is partially visible from both the face and back of the blind when closed. This ladder undesirably disrupts the otherwise continuous appearance of the window covering. Also, holes for the raising and tilting cords may also be visible when the Venetian blind is closed. This again detracts from the aesthetic appeal of the window covering, as well as permits additional light to penetrate a room even when the blind slats are closed. The present invention overcomes these shortcomings of the prior art by keeping ladder or other raising and adjustment mechanisms from view when the shade is closed.

SUMMARY OF THE INVENTION

An improved Venetian blind type window covering having an open position and a closed position is provided. When in a closed position, the window covering presents a face that conceals a securement member and an adjustment member. The window covering also includes a bottom rail, and a plurality of slats between the head rail and the bottom rail. The securement member and the adjustment member, in cooperation, are suitable for adjustably moving or tilting the plurality of blind slats to open and close the window covering.

The window covering also comprises a head rail having a blind slat tilting mechanism for raising and lowering at least the adjustment member. The blind slat tilting mechanism, in some embodiments, may also raise and lower the securement member. The blind slat tilting mechanism causes positional adjustment of the plurality of blind slats by raising and lowering at least the adjusting member. At least the securement member connects the head rail and a bottom rail with the plurality of blind slats positioned therebetween. Each of the plurality of slats is restrainedly positioned along the securement member at a row interval. The row interval is the distance between adjacent slats as measured along the securement members, and is preferably uniform for the entire window covering. Each of the slats is also restrainedly positioned with the adjustment members. For example, the movement of each plurality of slats relative to the securement members and adjustment members can be restricted by securing the slat to the securement members and adjustment members by way of adhesive, ultra-sonic welding, knitting, tying, or the like. Alternatively, the movement of the slats can be restricted by a ladder assembly extending between the securement member and adjustment member. As yet another alternative, the movement of the slats can be restricted by stop mechanisms positioned on the securement and adjustment members. A rigid securement strip to which the securement and adjustment members are connected can also be utilized to restrict movement of the blind slat relative to the securement and adjustment members. As another alternative, the securement member and the adjustment member may each be a series of cords secured between adjacent slats and thereby operatively connecting the head rail and bottom rail.

The plurality of slats can be formed of a variety of materials, such as wood, aluminum, fabric, or combinations thereof. Each of the plurality of slats further defines a front or distal edge portion which is longer than the row interval such that when the window covering is in the closed position, the securement member and the adjusting member are concealed from the face by the front or distal edge portion of an adjacent slat. For example, the front or distal edge portion can be the longitudinally extending width portion of a slat extending distally from the adjustment member. The portion of the slat extending proximally from the front or distal edge portion is the rear edge portion. When in a closed position, the rear edge portion of the adjacent slat, about which the adjustment member and the securement member are restrainedly positioned, is concealed by the front edge portion of the blind slat as it overlaps a portion of the adjacent slat when the window covering is in a closed position.

A number of cooperating forces are applied to each of the plurality of blind slats. A gravitational closing force is applied about the center of gravity of each of the slats. This gravitational closing force urges the front or distal end portion of the slats to move downwards towards a closed position. A countervailing lifting force is applied to each of the slats by the adjusting member which tends to cause the slats to tilt upwards and to open. A further counterbalancing force is applied to each of the slats by the securement member. This counterbalancing force is preferably greater than the lifting force.

The gravitational closing force is a constant downward force, which is offset by and at equilibrium with the lifting force when the position of the plurality of slats is stationary. When the adjusting member is extended by the tilting mechanism in the head rail, the lifting force is decreased such that the gravitational force overcomes the lifting force and the blind slats are tilted towards a closed position. By contrast, when the adjusting member is retracted by the tilting mechanism in the head rail, the lifting force is greater than the gravitational closing force so the blind slats are tilted upwards or opened.

The counterbalancing force is, however, greater than either of the gravitational force or the lifting force so slats pivot about a longitudinal region proximal to the front or distal edge portion. Where only the adjustment member is raised and lowered, the counterbalancing force is sufficiently great such that the longitudinal region about which the slats pivot is preferably located approximately about the point at which the securement member is restrainedly positioned with the slat and the longitudinal region extending therefrom. This pivot region remains substantially vertically stationary relative to the head rail when the tilting mechanism raises and lowers the adjustment member. Providing a sufficient counterbalancing force can be accomplished in several manners. For example, the bottom rail to which the securement member is connected can be of a sufficiently heavy weight to overcome the lifting force that may be applied to the slats. Alternatively, each slat may include a weighted strip on a proximal end to cause the center of gravity of the slat to shift closer to the longitudinal region such that the force applied to the center of gravity is lessened. As another alternative, each slat can be shaped with a thinner distal end portion to again shift the center of gravity towards the longitudinal region. Different materials may also be used in constructing the slats to achieve the same result. A combination of any of these methods may also be utilized.

As discussed, in some embodiments, the securement member can also be raised and lowered by the tilting mechanism. In particular, the tilting mechanism raises and lowers the securement and adjustment members in opposite vertical directions relative to one another, to pivot each slat about a longitudinal region proximal to the front or distal edge portion.

The securement member can take several forms including cords or a panel of material. An additional benefit of an embodiment of the window covering wherein a panel is utilized is that light may be permitted to enter a room while privacy is maintained. This is an improvement over window coverings, such as standard honeycomb type shades, which are typically made of semi-translucent material that allows light to pass when the shade is closed, while also maintaining a high degree of privacy, but cannot also block light when desired. The present window covering with the panel blocks the majority of light when the slats are closed, and permits light while maintaining privacy with the panel when the slats are open.

BRIEF DESCRIPTION OF THE DRAWINGS

In the drawings,

FIG. 9 is an enlarged perspective view of another preferred embodiment of fixedly securing the blind slats to the securement member and the adjustment member;

FIG. 10 is an enlarged view of another alternative embodiment of fixedly securing blind slats to a securement member.

DESCRIPTION OF THE PREFERRED EMBODIMENT OF THE INVENTION

Figure 1:
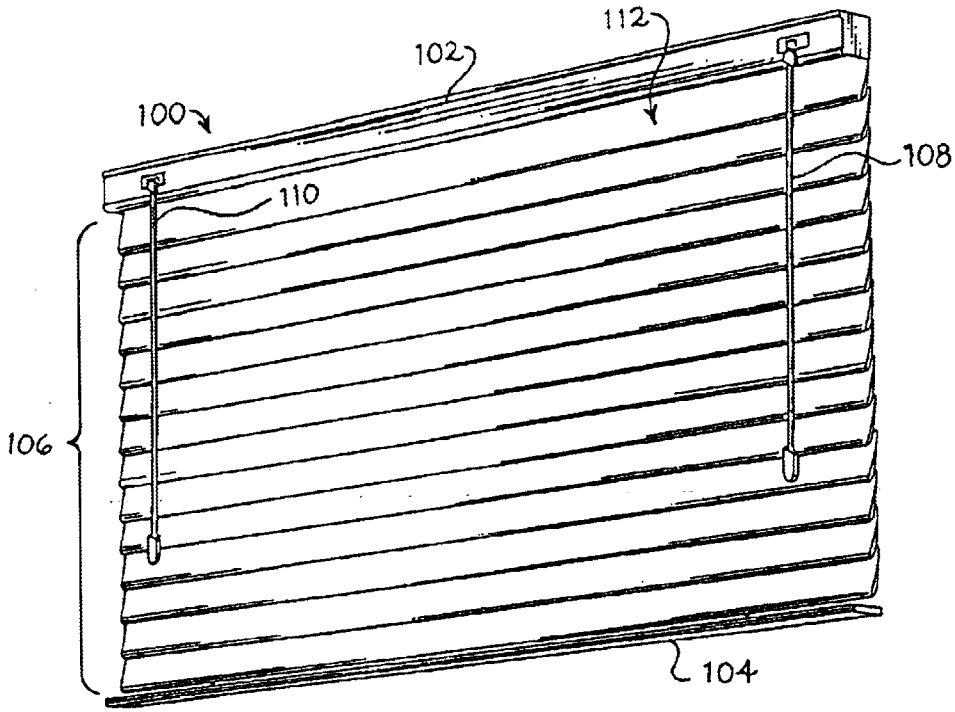
FIG. 1 is a perspective front view of a preferred embodiment of a closed window covering according to the present invention.

The invention disclosed herein is susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

A preferred embodiment of the present invention is shown in FIG. 1. Window shade 100 includes a head rail 102, a bottom rail 104, and a plurality of blind slats 106. Also provided is a tilting control wand 108 for actuating the tilting mechanism (not shown) in the head rail 102 to open or close the blind slats 106. A raising cord 110 extending between the head rail 102 and the bottom rail 104 is for raising the entire shade 100. The window shade 100 presents, on a face side 112, an appearance that is free of cords or other components connecting the plurality of slats 106, which would otherwise disrupt the aesthetic appearance of the window covering.

Although not shown in detail in the figures, the tilting mechanism can be any device for controllably raising and lowering a cord such as commonly found in Venetian blinds. For example, in an embodiment with a control wand, such as control wand 108 in FIG. 1, the control wand may simply comprise a worm gear for turning a spool upon which a cord is wound to raise the cord, or unwound to lower the cord. Alternatively, the tilting mechanism may be a cord lock whereby the user merely pulls on an adjustment cord to tilt and open the blind slats to a desired position and the cord is then locked in place. Such cord locks are often found in assemblies for raising an entire shade. Other mechanisms for controllably raising or lowering a cord as are known in the art may also be utilized.

Figure 2:
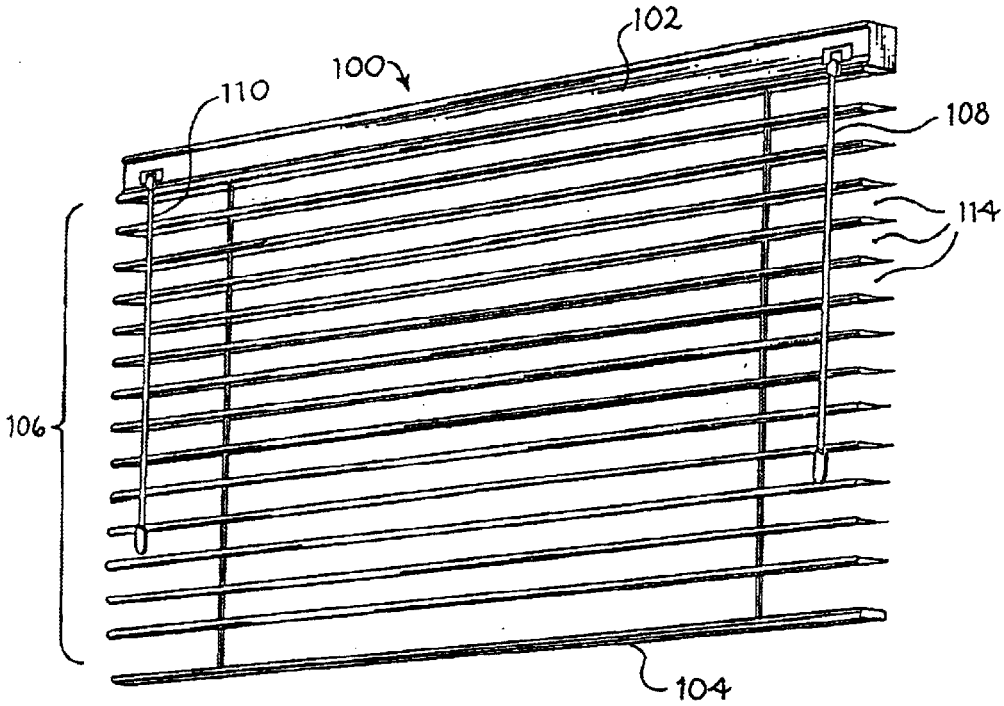
FIG. 2 is a perspective front view of the window covering of FIG. 1 partially open.

In a closed position, such as shown in FIG. 1, the window covering 100 offers a uniform uninterrupted appearance providing both privacy and light blocking. If it is desired to allow light into a room without raising the entire shade, and thereby retaining some degree of privacy, a user can rotate the tilting control wand 108. As the tilting control wand 108 is rotated and adjustment member 122 (FIG. 3) is raised, the angle of each of the plurality of slats 106 is adjusted such that gaps 114 in the window shade 100 are opened as shown in FIG. 2. The particular arrangement of each of the plurality of slats is discussed in further detail below.

Figure 3:
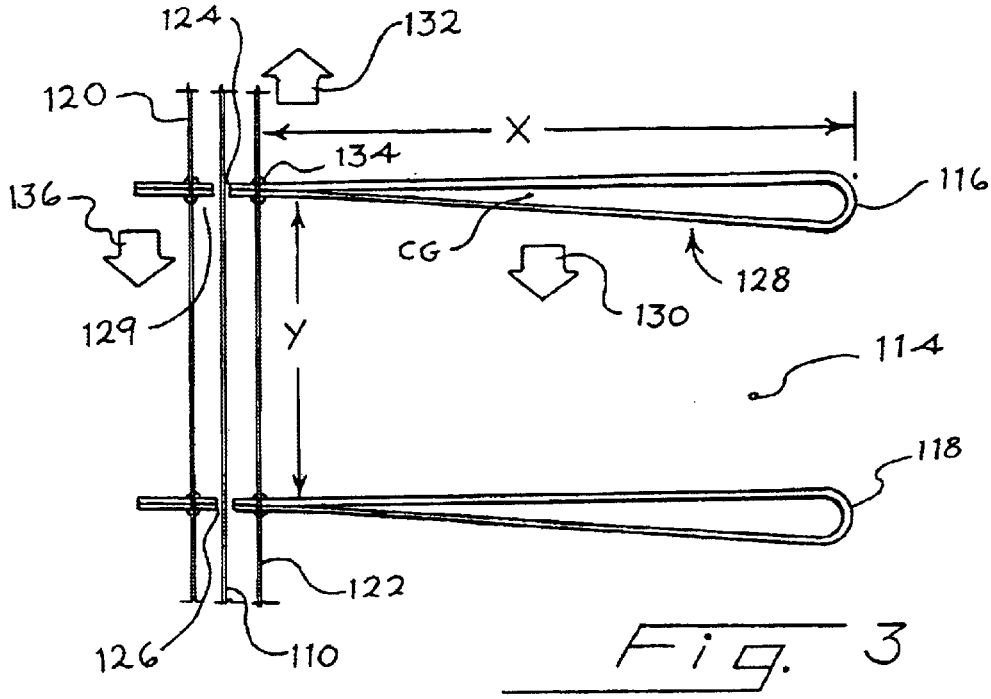
FIG. 3 is a cross sectional side view of a pair of adjacent blind slats of FIG. 1 partially opened.

Referring to FIG. 3, one embodiment for the arrangement of slats 116 and 118 is explained to demonstrate the arrangement of each of the plurality of slats in window covering 100. In this embodiment, securement member 120 and adjustment member 122 are each passed through and secured to slats 116 and 118. Slats 116 and 118 are fixedly secured to the securement member 120 and the adjustment member 122 by way of adhesive, ultrasonic welding, knitting, tying, or the like. As discussed in further detail below, the securement member 120 and adjustment member 122 may alternatively be restrainedly positioned with the blind slat through use of a plastic strip extending longitudinally along the blind slats to which the securement member 120 and adjustment member 122 are secured.

In this embodiment, the securement member 120 and adjustment member 122 are shown passing through slats 116 and 118. It is contemplated, however, that the securement member and adjustment member can be a series of cords, wherein each cord connects two adjacent slats.

Slats 116 and 118 also define holes 124 and 126 through which is passed raising cord 110. While the cords 110, 120 and 122 are shown to be co-planar, this is not required. The relative positions of the securement member 120 and the adjustment member 122 are such that one is positioned distal to the other. As shown, the adjustment member 122 is positioned distal to the securement member 120, however, the positions of the adjustment member 122 and securement member 120 can be reversed such that the securement member 120 is positioned distal to the adjustment member 122. In this alternate embodiment, the blind slats are opened by lowering the adjustment member and are closed by raising the adjustment member.

A row interval is shown as Y and a center of gravity for slat 116 is depicted as CG. The width of the front or distal edge portion 128 of slat 116 is indicated as X extending from the adjustment member 122. While only one set of cords, i.e., securement member 120, adjustment member 122, and raising cord 110, is shown in FIG. 3, it is preferred that a pair of sets of cords of similar configuration be equidistantly spaced from opposing sides of the window shade as shown in FIG. 2. The edge portion of slat 116 opposite the front edge portion 128 is the rear edge portion 129 to which securement member 120 and adjustment member 122 are secured.

In operation, various forces are applied to the blind slats. Blind slat 116 is discussed by way of example. The gravitational force effectively applied to center of gravity CG is shown as force arrow 130. A lifting force which is depicted as force arrow 132 is also applied to blind slat 116 by adjustment member 122 at the region where blind slat 116 is fixed to adjustment member 122. A counterbalancing force which is shown as force arrow 136 is applied to blind slat 116 by securement member 120 at the region where blind slat 116 is fixed to securement member 120. When it is desired to adjust the angle of the blind slats, the tilting mechanism is preferably controlled by the tilting control wand 108 (FIG. 1). Turning the tilting control wands causes the tilting mechanism in the head rail to extend or retract the adjustment member 122 and thereby adjust the angle of the blind slats. Extending the adjustment member 122 reduces the force 132 such that the gravitational force 130 causes the blind slat 116 to move downwards, whereas retracting the adjustment member 122 increases the force 132 and overcomes the gravitational force 130 and raises the distal end portion 128 and thereby tilts blind slat 116 upwards. As stated, counterbalancing force 136 is greater than lifting force 132 even when adjustment member 122 is being retracted such that the point at which the securement member 120 is fixed to the slat 116 and the longitudinal region extending therefrom remains vertically stable relative to the head rail during any adjustment of the angle of the blind slats.

The width of front or distal edge portion 128, denoted as X, is greater than the row interval distance which is indicated as Y. As such, when adjustment member 122 is extended such that front or distal edge portion 128 of blind slat 116 is lowered to contact adjacent blind slat 118, hole 126, adjustment member 122, and securement member 120 are concealed from the face of the window covering, when viewed from one direction, by front or distal edge portion 128.

Figure 4:
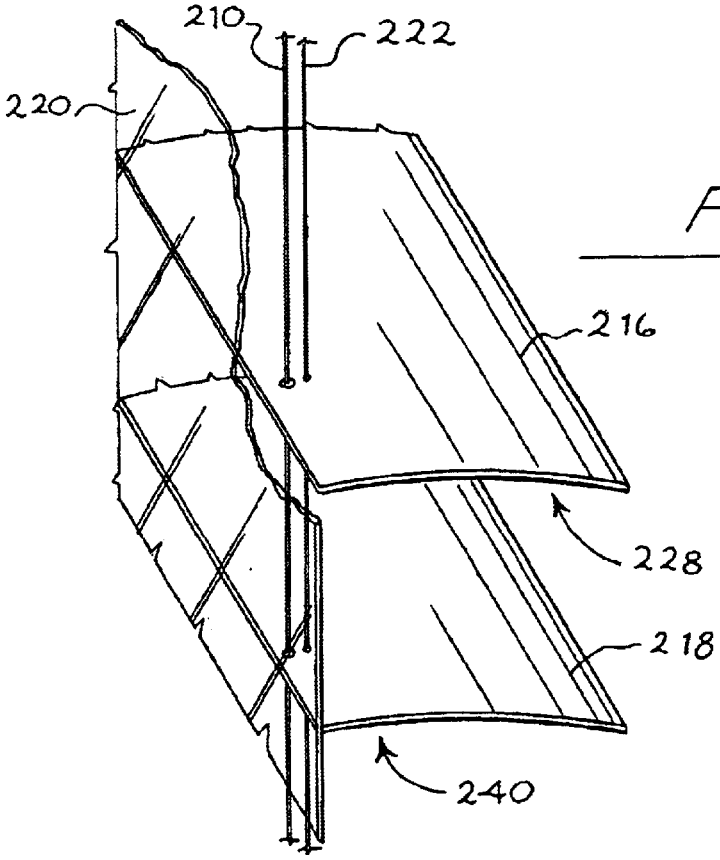
FIG. 4 is a perspective side view, partially in section, of a pair of adjacent blind slats according to an alternate embodiment of the window covering.

An alternate embodiment of the improved window covering is shown as FIG. 4. Again, reference is made to a pair of blind slats 216 and 218 as exemplary of the plurality of blind slats in the window covering. This embodiment is similar to the previous embodiment except that instead of a cord being utilized as a securement member 220, a panel of material is provided. Also provided are adjustment member 222 and raising cord 210. Securement member 220 may be a panel extending the entirety of the window covering, and which may be comprised of a semitransparent material. With such an arrangement, blind slats can be tilted to permit light to enter a room, but still maintain a high degree of privacy. If desired, the panel can be opaque, transparent, or include a design. It is preferred that a pair of sets of cords 222 and 210, i.e., adjustment member 222 and raising cord 210, be equidistantly spaced from the edges of the window covering.

The overall operation of the embodiment shown in FIG. 4 is the same as discussed with respect to the embodiment shown in FIG. 3. As adjustment member 222 is raised or lowered, blind slats 216 and 218 are opened or closed, respectively. Again, rear edge portion 240 of adjacent slat 218 about which adjustment member 222 and securement member 220 are restrainedly positioned are concealed by the front edge portion 228 of blind slat 216 as it overlaps the rear edge portion 240 of adjacent slat 218 when the window covering is in a closed position.

Figure 5:
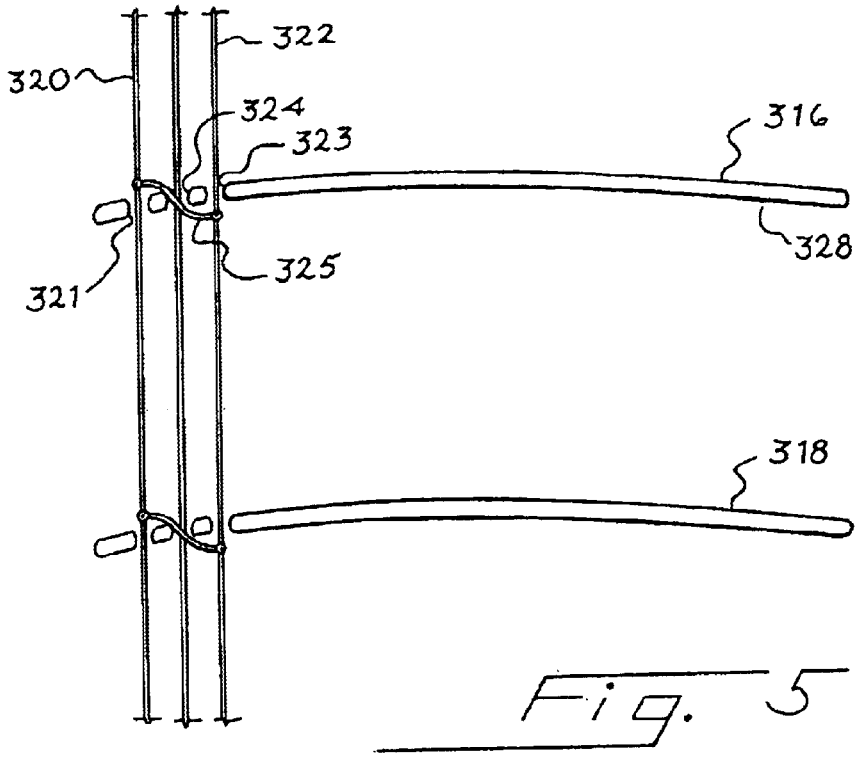
FIG. 5 is a cross section side view of a pair of adjacent blind slats according to another alternate embodiment of the window covering.

Another embodiment of the improved window covering is shown in FIG. 5. The arrangement of slats 316 and 318 is again provided to demonstrate the configuration of each of the plurality of slats. In this embodiment, securement member 320 and adjustment member 322 are passed through holes 321 and 323, respectively. Unlike the embodiment shown in FIG. 3, the securement member 320 and adjustment member 322 are not fixedly secured to blind slats 316 and 318. Instead, referring to slat 316, securement member 320 and adjustment member 322 are restrainedly positioned by being restricted in their movement by ladder rung 325, which comprises a string or cord secured to adjustment member 322 below slat 316 and secured to securement member 320 above slat 316. Ladder rung 325 is further passed through hole 324, through which raising cord 310 is also passed. Ladder rung 325 restricts the upward movement of the blind slat 316 along securement member 320 and restricts the downward movement along adjustment member 322. Similar to the embodiment shown in FIG. 3, it is preferred that a pair of cord sets comprising the securement member 320, the adjustment member 322, the raising cord 310, and the ladder rung 325 be included, and be spaced equidistantly from opposing sides of the window covering.

Thus far, in each of the embodiments provided, the securement member remains stationary relative to the head rail, while the adjustment member is raised and lowered. An alternate embodiment wherein both the securement member and adjustment member are raised or lowered may also be utilized. In particular, as adjustment member 322 is raised, securement member 320 is lowered, and similarly as adjustment member 322 is lowered, securement member 320 is raised. The tilting mechanism for this embodiment can be any mechanism that can simultaneously raise one cord while lowering another. For example, the tilting mechanism found in standard Venetian blinds for raising and lowering the front and rear of a ladder assembly is suitable. As with the previous embodiment, when the window shade is in a closed position no cords or ladders are visible from the face because the front or distal edge of the slats, such as front or distal edge 328, overlaps the lower adjacent slat.

Figure 6:
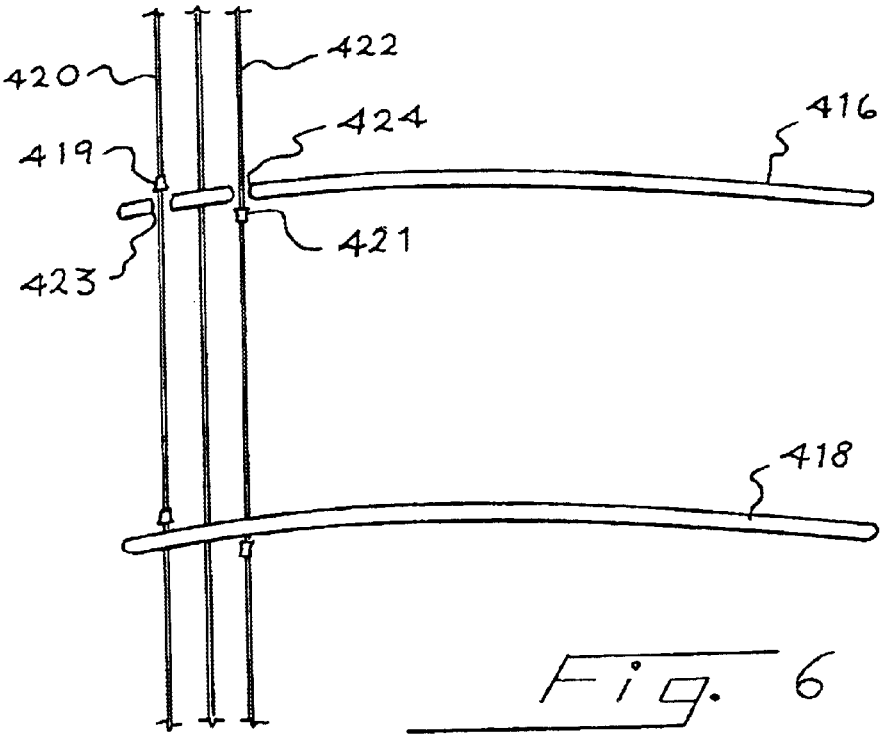
FIG. 6 is a side view of a pair of adjacent blind slats according to yet another alternate embodiment of the window covering.

Yet another method for restrainedly positioning the blind slats relative to the securement member and adjustment member is shown in FIG. 6. Sccurement member 420 and adjustment member 422 are passed through holes 423 and 424, respectively. In order to restrainedly position blind slats 416 and 418 relative to securement member 420 and adjustment member 422, a stop 419 and a rest 421 are fixedly secured to securement member 420 and adjustment member 422, respectively. Stop 419 is configured such that a portion thereof adjacent to the slat 416 is larger than hole 423. Rest 421 is similarly configured to include a portion larger than hole 424. Accordingly, stop 419 restricts the upward movement of the blind slat 416 along the securement member 420 and rest 421 restricts the downward movement along adjustment member 422. The opening and closing of the window covering through tilting the slats is as discussed above in previous embodiments.

Figure 7:
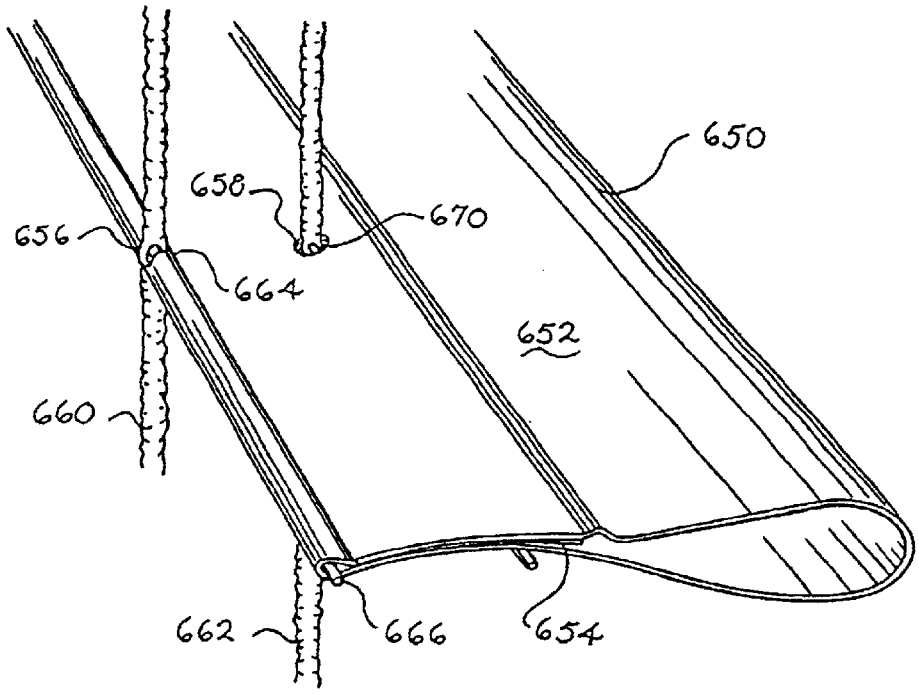
FIG. 7 is an enlarged perspective view of a preferred embodiment of fixedly securing the blind slats to the securement member and the adjustment member.
Figure 8:
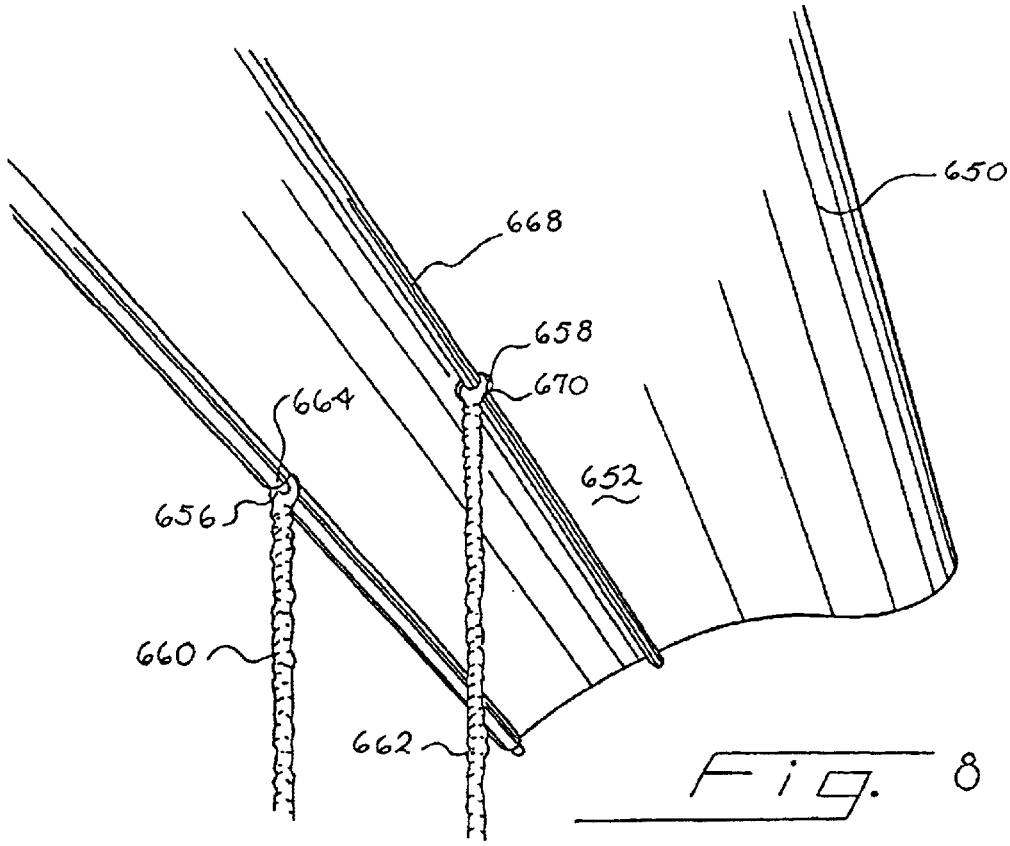
FIG. 8 is an enlarged bottom view of the embodiment of FIG. 7.

As discussed above, the securement member and the adjustment member can be restrainedly positioned with the plurality of blind slats in a variety of ways. Shown in FIGS. 7 and 8 is one preferred embodiment utilizing a plastic strip. Blind slat 650 comprises a piece of material 652 that is folded upon itself such that its opposing edge sandwich a reinforcing strip 654. Material 652 defines holes 656 and 658 and are sized to permit securement member 660 and adjustment member 662, respectively. Formed with securement member 660 is loop 664. A rigid securement strip 666 that is preferably formed of plastic is also sandwiched by the opposing edges of material 652 about a proximal edge of the blind slat 650. Rigid securement strip 666 intersects with hole 656 and is passed through loop 664. As such, securement member is secured to blind slat 650. Referring to FIG. 8, loop 670 is similarly formed with adjustment member 662. Rigid securement strip 668 is passed through loop 670 formed in adjustment member 662, which is passed through hole 658. Rigid securement strip 668 is positioned below blind slat 650. As such, blind slat 650 is restrainedly positioned with adjustment member 662 and plastic strip 668 because the downward movement of the slat 650 relative to the adjustment member 662 is restricted by the strip 668. If desired, the strip 668 can be fixedly secured to the slat 650, such as by an adhesive.

Yet another way of restrainedly positioning the blind slats and the securement and adjustment members is shown in FIGS. 9 and 10. In this embodiment, blind slat 750 comprises a piece of material 752 that is folded upon itself such that its opposing edge sandwiches a reinforcing strip 754. Securement member 760 and adjustment member 762 pass through holes 756 and 758, respectively. Similar to the previous embodiment, each of the securement member 760 and adjustment member 762 are formed with loops 764 and 770, respectively. The securement member 760 and adjustment member 762 are each passed through the loop and secured to plastic strips 766 and 768. Alternatively, a hole 772 can be formed adjacent from but not coincident with edge 774 such that, in this case, the securement member 776 is tied to the blind slat 778 directly, as shown in FIG. 10. In such an embodiment, no plastic securement strips are needed, but may be included if desired.

Figure 11:
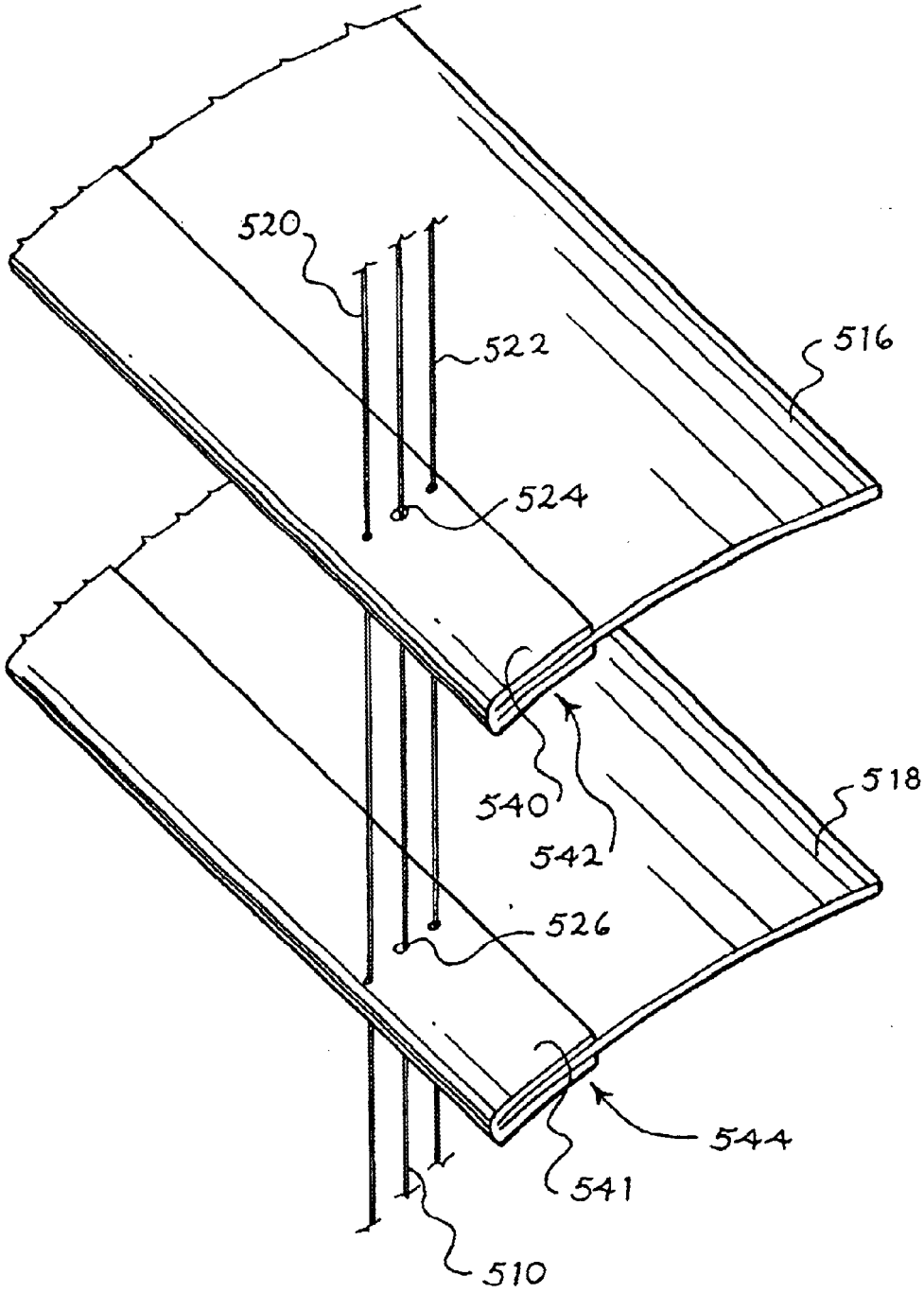
FIG. 11 is a perspective view of a pair of adjacent blind slats according to a further embodiment of the window covering.

An optional feature that may be included in any of the embodiments is a reinforcing strip as shown in FIG. 11. In this embodiment, securement member 520 and adjustment member 522 are each passed through and secured to slats 516 and 518. Slats 516 and 518 are fixedly secured to the securement member 520 and the adjustment member 522 and also define holes 524 and 526 through which is passed raising cord 510. Reinforcing strip 540, such as a thin metal strip or the like, is also included. The reinforcing strips 540 and 541 enhance the securement between the securement member 520 and the slats 516 and 518. Reinforcing strips 540 and 541 may also serve the further purpose of providing additional weight on the proximal end portion 542 and 544 of slats 516 and 518, respectively. In so doing, the center of gravity of the slats is shifted closer to the proximal end portions 542 and 544, which lessens the required amount of counterbalancing force to be applied by the securement member 520, such as provided by the weight of the bottom rail. It is preferred that the reinforcing strips 540 and 541 extend the length of the slats, however, it is possible for a strip to only extend a portion of the slats.

The foregoing descriptions are to be taken as illustrative, but not limiting. Still other variants within the spirit and scope of the present invention will readily present themselves to those skilled in the art.

What is claimed is:

1. A Venetian blind type window covering having a closed position, an open position, and a face, and comprising:

a head rail having a blind slat tilting mechanism for raising and lowering at least an adjustment member, a securement member operatively connecting the head rail and a bottom rail;

a plurality of slats between the head rail and the bottom rail, each of the slats including a distal edge portion and restrainedly positioned along the securement member and the adjustment member at a row interval, wherein each of the plurality of slats is pivotally biased towards the distal edge portion;

the distal edge portion for each of the slats being longer than the row interval such that when the window covering is in the closed position, the securement member and the adjustment member are concealed from the face by a distal edge portion of an adjacent slat; and the blind slat tilting mechanism causing positional adjustment of the plurality of blind slats by raising and lowering the adjusting member independent of the securement member.

2. The window covering of claim 1, wherein the securement member is a cord.

3. The window covering of claim 1, wherein the securement member is a panel.

4. The window covering of claim 3, wherein the panel is a semi-transparent material.

5. The window covering of claim 3, wherein the panel is a transparent material.

6. The window covering of claim 3, wherein the panel is an opaque material.

7. The window covering of claim 1, wherein a counterbalancing force is applied to the plurality of slats, the counterbalancing force being greater than a lifting force applied to each of the slats by the adjustment member.

8. The window covering of claim 1, wherein each of the plurality of slats is fixedly secured to the securement member and the adjustment member.

9. The window covering of claim 1, wherein each of the plurality of slats is restrainedly positioned with the securement member and the adjustment member by a stop and a rest.

10. The window covering of claim 9, wherein the stop is fixedly secured to the securement member and the rest are fixedly secured to the adjustment member.

11. The window of claim 1, wherein each of the plurality of slats is restrainedly positioned with the securement member and the adjustment member by a rigid securement strip.

12. The window covering of claim 1, wherein each of the plurality of blind slats further includes a reinforcing strip.

13. The window covering of claim 1, wherein the tilting mechanism comprises a control wand.

14. The window covering of claim 1, wherein the tilting mechanism comprises a cord lock.

15. A Venetian blind type window covering having an open position and a closed position comprising:

a head rail, a bottom rail, an adjustment member, and a securement member;

a blind slat tilting mechanism for raising and lowering at least the adjustment member, wherein the adjustment member is capable of being raised or lowered independent of the securement member;

a plurality of slats between the head rail and the bottom rail, each of the slats spaced a row interval from an adjacent slat;

each of the plurality of slats being restrainedly positioned with the adjustment member and securement member, the plurality of slats also being movable between the open position and the closed position by the adjustment member and the securement member;

each slat further defining a front edge portion which is of a greater width than the row interval;

wherein each slat is balanced such that the front edge portion is biased towards the closed position; and wherein when the window covering is in the closed position, the adjustment member and securement member are concealed from the face by the front edge portions of the plurality of slats.

16. The window covering of claim 15, wherein the securement member is a cord.

17. The window covering of claim 15, wherein the securement member is a panel.

18. The window covering of claim 17, wherein the panel is a semi-transparent material.

19. The window covering of claim 17, wherein the panel is a transparent material.

20. The window covering of claim 17, wherein the panel is an opaque material.

21. The window covering of claim 15, wherein a counterbalancing force is applied to the plurality of slats, the counterbalancing force being greater than a lifting force applied to each of the slats by the adjustment member.

22. The window covering of claim 15, wherein each of the plurality of slats is fixedly secured to the securement member and the adjustment member.

23. The window covering of claim 15, wherein each of the plurality of slats is restrainedly positioned with the securement member and the adjustment member by a stop and a rest.

24. The window covering of claim 23, wherein the stop is fixedly secured to the securement member and the rest are fixedly secured to the adjustment member.

25. The window of claim 15, wherein each of the plurality of slats is restrainedly positioned with the securement member and the adjustment member by a rigid securement strip.

26. The window covering of claim 15, wherein each of the plurality of blind slats further includes a reinforcing strip.

27. The window covering of claim 15, wherein the tilting mechanism comprises a control wand.

28. The window covering of claim 15, wherein the tilting mechanism comprises a cord lock.

29. The window covering of claim 1, wherein the securement member is a continuous member.

30. The window covering of claim 1, wherein the adjustment member is a continuous member.

31. A Venetian blind type window covering having a closed position, an open position, and a face, and comprising:

a head rail having a blind slat tilting mechanism for raising and lowering an adjustment member, a securement member operatively connecting the head rail and a bottom rail;

a plurality of slats between the head rail and the bottom rail, each of the slats restrainedly positioned along the securement member and the adjustment member at a row interval, each of the plurality of slats further including a distal edge portion;

the distal edge portion for each of the slats being longer than the row interval such that when the window covering is in the closed position, the securement member and the adjustment member are concealed from the face by a distal edge portion of an adjacent slat, the distal end portion being biased towards the closed position; and the blind slat tilting mechanism causing positional adjustment of the plurality of blind slats by raising and lowering the adjusting member independent of the securement member.

32. The window covering of claim 31, wherein the securement member is a cord.

33. The window covering of claim 31, wherein the securement member is a panel.

34. The window covering of claim 33, wherein the panel is a semi-transparent material.

35. The window covering of claim 33, wherein the panel is a transparent material.

36. The window covering of claim 33, wherein the panel is an opaque material.

37. The window covering of claim 31, wherein a counterbalancing force is applied to the plurality of slats, the counterbalancing force being greater than a lifting force applied to each of the slats by the adjustment member.

38. The window covering of claim 31, wherein each of the plurality of slats is fixedly secured to the securement member and the adjustment member.

39. The window covering of claim 31, wherein each of the plurality of slats is restrainedly positioned with the securement member and the adjustment member by a stop and a rest.

40. The window covering of claim 39, wherein the stop is fixedly secured to the securement member and the rest are fixedly secured to the adjustment member.

41. The window of claim 31, wherein each of the plurality of slats is restrainedly positioned with the securement member and the adjustment member by a rigid securement strip.

42. The window covering of claim 31, wherein each of the plurality of blind slats further includes a reinforcing strip.

43. The window covering of claim 31, wherein the tilting mechanism comprises a control wand.

44. The window covering of claim 31, wherein the tilting mechanism comprises a cord lock.

45. The window covering of claim 31, wherein the securement member is a continuous member.

46. The window covering of claim 31, wherein the adjustment member is a continuous member.

47. A Venetian blind type window covering having a closed position, an open position, and a face, and comprising:

a head rail having a blind slat tilting mechanism for raising and lowering an adjustment member and a securement member, a bottom rail;

the securement member and the adjustment member connected to the head rail;

a plurality of slats between the head rail and the bottom rail, each of the slats restrainedly positioned along the securement member and the adjustment member at a row interval, each of the plurality of slats further including a distal edge portion;

the distal edge portion for each of the slats being longer than the row interval such that when the window covering is in the closed position, the securement member and the adjustment member are concealed from the face by a distal edge portion of an adjacent slat, the distal end portion being biased towards the closed position; and the blind slat tilting mechanism enabling positional adjustment of the plurality of blind slats by adjusting the position of the adjusting member independent of the securement member.

48. The window covering of claim 47, wherein the securement member is a cord.

49. The window covering of claim 47, wherein the securement member is a panel.

50. The window covering of claim 49, wherein the panel is a semi-transparent material.

51. The window covering of claim 49, wherein the panel is a transparent material.

52. The window covering of claim 49, wherein the panel is an opaque material.

53. The window covering of claim 47, wherein a counterbalancing force is applied to each of the plurality of slats about a pivot region, the counterbalancing force being greater than a lifting force applied to each of the slats by the adjustment member.

54. The window covering of claim 47, wherein each of the plurality of slats is fixedly secured to the securement member and the adjustment member.

55. The window covering of claim 47, wherein each of the plurality of slats is restrainedly positioned with the securement member and the adjustment member by a ladder rung.

56. The window covering of claim 47, wherein each of the plurality of slats is restrainedly positioned with the securement member and the adjustment member by a stop and a rest.

57. The window covering of claim 56, wherein the stop is fixedly secured to the securement member and the rest are fixedly secured to the adjustment member.

58. The window of claim 47, wherein each of the plurality of slats is restrainedly positioned with the securement member and the adjustment member by a rigid securement strip.

59. The window covering of claim 47, wherein each of the plurality of blind slats further includes a reinforcing strip.

60. The window covering of claim 47, wherein the tilting mechanism comprises a control wand.

61. The window covering of claim 47, wherein the tilting mechanism comprises a cord lock.

62. A Venetian blind type window covering having a closed position, an open position, and a face, and comprising:

a head rail having a blind slat tilting mechanism for raising and lowering at least an adjustment member;

a securement member comprising a fabric panel connected to the head rail and a bottom rail;

a plurality of slats between the head rail and the bottom rail, each of the slats restrainedly positioned along the securement member and the adjustment member at a row interval, each of the plurality of slats further including a distal edge portion;

the distal edge portion for each of the slats being longer than the row interval such that when the window covering is in the closed position, the securement member and the adjustment member are concealed from the face by a distal edge portion of an adjacent slat; and the blind slat tilting mechanism causing positional adjustment of the plurality of blind slats by raising and lowering the adjusting member.

63. The window covering of claim 62, wherein the blind slat tilting mechanism further raises the securement member.

64. The window covering of claim 63, wherein blind slat tilting mechanism causes the securement member to move in an opposite direction from the adjustment member.

65. The window covering of claim 62, wherein the panel is a semi-transparent material.

66. The window covering of claim 62, wherein the panel is a transparent material.

67. The window covering of claim 62, wherein the panel is an opaque material.

68. The window covering of claim 62, wherein a counterbalancing force is applied to each of the plurality of slats about a pivot region, the counterbalancing force being greater than a lifting force applied to each of the slats by the adjustment member.

69. The window covering of claim 62, wherein each of the plurality of slats is fixedly secured to the securement member and the adjustment member.

70. The window of claim 62, wherein each of the plurality of slats is restrainedly positioned with the adjustment member by a rigid securement strip.

71. The window covering of claim 62, wherein each of the plurality of blind slats further includes a reinforcing strip.

72. The window covering of claim 62, wherein the tilting mechanism comprises a control wand.

73. The window covering of claim 62, wherein the tilting mechanism comprises a cord lock.

74. The window covering of claim 62, wherein the panel extends across the window covering.

75. The window covering of claim 3, wherein the panel extends across the window covering.

76. The window covering of claim 17, wherein the panel extends across the window covering.

77. The window covering of claim 33, wherein the panel extends across the window covering.

78. The window covering of claim 49, wherein the panel extends across the window covering.

* * * * *